United States Patent [19]

Masumoto et al.

[11] Patent Number: 4,642,145

[45] Date of Patent: Feb. 10, 1987

[54] NICKEL ALLOY

[75] Inventors: Tsuyoshi Masumoto; Akihisa Inoue, both of Miyagi; Hiroyuki Tomioka, Kyoto, all of Japan

[73] Assignees: Tsuyoshi Masumoto, Miyagi; Unitika Ltd., Hyogo, both of Japan

[21] Appl. No.: 473,301

[22] Filed: Mar. 8, 1983

[30] Foreign Application Priority Data

Mar. 8, 1982 [JP] Japan ..... 57-36226
Aug. 30, 1982 [JP] Japan ..... 57-150361

[51] Int. Cl.[4] ..... C22C 38/08; C22C 19/00

[52] U.S. Cl. ..... 148/336; 148/425; 148/428; 148/429; 148/442

[58] Field of Search ..... 420/460, 459; 148/425, 148/428, 429, 442, 31

[56] References Cited

U.S. PATENT DOCUMENTS 2,910,356 10/1959 Grala et al. ..... 420/460

*Primary Examiner*—R. Dean

*Attorney, Agent, or Firm*—Sughrue, Mion, Zinn, Macpeak & Seas

[57] ABSTRACT

Ni-based alloys comprising 8 to 34 atom % of Al, 2 to 70 atom % of one or more elements selected from the group consisting of Fe, Co, Mn, and Si (providing that each or total of Fe and Co is present in an amount of 2 to 70 atom % and/or each or total of Mn and Si is present in an amount of 2 to 25 atom %), and the balance to make up to 100 atom % of substantially pure Ni, and possessing great strength and high ductility.

These alloys enjoy outstanding ductility and strength and, therefore, are ideally useful for various filter materials and composite materials.

12 Claims, No Drawings

NICKEL ALLOY

FIELD OF THE INVENTION

This invention relates to Ni-based alloys which possess great strength and high ductility.

BACKGROUND OF THE INVENTION

A Ni-based alloy which has presently found popular acceptance is a super heat-resisting alloy which has a $Ll_2$ type $Ni_3Al$ intermetallic compound precipitated or dispersed in its Ni matrix. A review of the equilibrium diagram of the conventional Ni-Al binary alloy, for example, reveals that, at room temperature, this alloy keeps $Ni_3Al$ and Ni in coexistence when the Al content thereof falls in the range of about 23 to 28 atom% and the alloy constitutes itself a solid solution of Al in Ni when the Al content is not more than about 8 atom%. In such Ni-based $Ll_2$ type intermetallic compounds, those which contain such compounds as $Ni_3Ge$, $Ni_3Si$, and $Ni_3Al$ are characterized, as reported in *Trans,* JIM, 20, (1979), 634 and *Trans,* JIM, 21, (1980), 273, by acquiring higher strength at elevated temperatures than at room temperature. Accordingly, the usefulness of these intermetallic compounds at elevated temperatures has become apparent. The conventional Ni-based $Ll_2$ type intermetallic compounds keep their crystalline structures regularized at temperature up to the neighborhood of their melting points. At room temperature, therefore, they are too brittle to be worked by ordinary methods such as are available for rolling or drawing, for example.

In view of these circumstances, studies are being actively carried out to determine a method for imparting ductility at room temperature to the Ni-based $Ll_2$ type intermetallic compounds which cannot be molded by any other method than the casting method. Only one report on successful improvement of the ductility at room temperature of $Ni_3Al$ by the incorporation of B is found in *Journal of Japan Metal Study Society,* 43 (1979), 358, 1190. According to the report, the $Ll_2$ type intermetallic compound $Ni_3Al$ which was brittle was provided with higher ductility and also improved strength at rupture and elongation owing to the incorporation of B. However, any improvements in mechanical properties do not appear to be great. The compound reportedly improved by the incorporation of B, when annealed at elevated temperatures, induces precipitation of B in the grain boundary and suffer notable loss of strength and ductility at elevated temperatures. Thus, this compound has no appreciable feasibility.

Separately, basic studies with single crystals are being carried out concerning the B-2 type intermetallic compounds. Since these compounds are brittle and incapable of plastic working similarly to the $Ll_2$ type intermetallic compounds, they are now adopted in their brittle form in the manufacture of alnico magnets, for example. A report has been recently published (Glossary of Abstracts of Lectures at the Spring, 1982, meeting of Japan Metal Study Society, p. 249) to the effect that Fe-Cr-Al-Nb type alloys, when quenched and solidified by the liquid coolant method, produced B-2 type intermetallic compounds having ductility and exhibiting high electric resistance.

SUMMARY OF THE INVENTION

An object of this invention is to provide a Ni-based alloy which exhibits great strength and possesses high ductility.

The present inventors studied the conventional binary Ni-Al alloy with respect to the behavior of the alloy during the course of the quenching thereof from the molten state. They consequently found that Ni-Al alloy composition having an Al content of not more than about 8 atom% formed a solid solution of Al in Ni having a face-centered cubic structure and showing poor strength without forming $Ni_3Al$, a Ni-Al alloy composition having an Al content in the range of 8 to 23 atom% had $Ni_3Al$ and Ni in coexistence, possessed ductility, and exhibited strength of not more than 50 $kg/mm^2$, and a Ni-Al alloy composition having an Al content of at least 23 atom% formed a $Ll_2$ type intermetallic compound $Ni_3Al$ and nevertheless failed to serve as a material applicable to actual use. They continued the study diligently and, consequently have ascertained that a molten N-based alloy of a specific composition, when quenched and solidified, produces a novel Ni-based alloy possessing great strength and high ductility. The present invention has been perfected on the basis of this knowledge.

Specifically, the present invention is directed to a Ni-based alloy which comprises 8 to 34 atom% of Al, 2 to 70 atom% of at least one element selected from the group consisting of Fe, Co, Mn, and Si (providing that each or total content of Fe and Co is present in an amount of 2 to 70 atom% of the entire alloy and/or each or total content of Mn and Si is present in an amount of 2 to 25 atom% of the entire alloy), and the balance to make up 100 atom% of substantially pure Ni and possessing great strength and high ductility.

The Ni-based alloy of the present invention has extremely high strength and ductility. Further, the alloy is capable of continuous cold working as well as exhibiting thermal resistance. The alloy is further resistant to corrosion and oxidation, and excellent electromagnetic properties. Accordingly, the invention is highly useful for various industrial materials such as composite materials and filter materials.

DETAILED DESCRIPTION OF PREFERRED EMBODIMENT

The alloy of the present invention comprises 8 to 34 atom% of Al, 2 to 70 atom% of at least one element selected from the group consisting of Fe, Co, Mn and Si (providing that each or total content of Fe and Co is present in an amount of 2 to 70 atom% of the entire alloy and/or each or total content of Mn and Si is present in an amount of 2 to 25 atom% of the entire alloy), and the balance to make up 100 atom% of substantially pure Ni.

The composition defined above proves to be more desirable particularly when the content of Al is limited to the range of 8 to 28 atom% and the content of at least one member selected from the group consisting of Fe, Co, Mn, and Si is limited to the range of 2 to 25 atom% (providing that the content of Fe, if used, is limited to the range of 2 to 15 atom% of the entire alloy, preferably 2 to 10 atom%). When the element are present in these proportions, the alloy composition makes a Ni-based alloy in the form of a $Ll_2$ type nonequilibrium intermetallic compound. This alloy consists of microcrystals having particle diameters of about 0.5 to 10 μm, preferably 0.5 to 5 μm. Within these microcrystals there is a $Ll_2$ type nonequilibrium intermetallic compound made up of superfine particles of antiphase domain measuring not less than about 5 nm and not more than about 70 nm in diameter, preferably 5 to 20 nm. This $Ll_2$ type nonequilibrium intermetallic compound contains a large amount of high-density antiphase boudaries within the crystal grains. Accordingly, the alloy has notably improved strength and ductility as compared with the conventional $Ll_2$ type intermetallic compound. The crystal grains of this alloy are not more than 10 μm in diameter. The small size of the crystal grains contributes to increasing the strength of the alloy.

The composition mentioned above fails to produce the $Ll_2$ type nonequilibrium intermetallic compound and instead gives rise to a solid solution of Al in Ni when the Al content falls below the lower limit of 8 atom%. For the alloy to acquire higher strength and ductility while the Al content is retained in the range of 8 to 28 atom%, the content 2 to 25 atom% of at least one element selected from the group consisting of Fe, Co, Mn and Si (hereinafter referred to as X) (providing that Fe, if used, accounts for 2 to 15 atom%) is to be substituted with Ni. If X is less than the lower limit of 2 atom%, the superfine particles (not more than 70 nm in diameter) of the antiphase domain do not occur within the microcrystals and the produced $Ll_2$ type intermetallic compound does not include the high-density antiphase boundaries. This alloy is too brittle to suit actual use. Preferably, the Ni-based alloy in the form of $Ll_2$ type nonequilibrium intermetallic compound contemplated by the present invention is preferably comprised of 10 to 25 atom% of Al, 5 to 20 atom% of X (providing that Fe, if used, accounts for 5 to 15 atom%), and the balance to make up 100 atom% of substantially pure Ni.

A composition comprising 8 to 34 atom% of Al, 15 to 70 atom% of at least one element selected from Fe and Co (providing that Fe accounts for 15 atom% or more and 70 atom% or less and Co for 25 atom% or more and 70 atom% or less), and the balance to make up 100 atom% of substantially pure Ni makes up a Ni-based alloy containing a B-2 type intermetallic compound possessing great strength and high ductility. Particularly in a composition region having a high Al (15 to 34 atomic %), high Fe (20 to 70 atomic %), and high Co (30 to 70 atomic %) content, this alloy acquires the monophase structure of a B-2 type intermetallic compound whose crystals have minute particle diameters of not more than about 10 μm. In a composition region having a low Al (8 to 25 atomic %) content and a high Fe and high Co content, this alloy acquires a structure in which crystal grains of a B-2 type intermetallic compound and crystal grains of a $Ll_2$ type nonequilibrium intermetallic compound (specifically a $Ll_2$ type $Ni_3Al$ intermetallic compound) are intermingled. These crystal grains have much smaller particle diameters of not more than 1 μm. This alloy possesses greater strength than the monophase alloy of a $Ll_2$ type $Ni_3Al$ intermetallic compound. If the aforementioned Al content is less than 8 atom%, the composition fails to produce the B-2 type intermetallic compound and instead gives rise to a solid solution of Al in Ni. If the Al content exceeds 34 atom%, the composition produces a structure having the $Ll_2$ type $Ni_3Al$ intermetallic compound precipitated in the grain boundaries of the B-2 type intermetallic compound. This alloy is too brittle to suit actual use.

The at least one element selected from Fe and Co must be present in an amount of not less than 15 atom% and not more than 70 atom% (providing that Fe accounts for not less than 15 atom% and not more than 70 atom% and Co for not less than 25 atom% and not more than 70 atom%). If the Fe content is not more than 15 atom% and the Co content is not more than 25 atom%, the composition acquires the monophase structure of a $Ll_2$ type $Ni_3Al$ intermetallic compound. If the Fe content exceeds 70 atom%, there ensues precipitation of FeAl, $Fe_3Al$, etc. If the Co content exceeds 70 atom%, the composition produces a B-2 type intermetallic compound having a $Ll_2$ type $Ni_3Al$ intermetallic compound precipitated in the grain boundaries. In either of these cases, the alloy is brittle. Among these alloys, a ternary Ni-Al-Fe alloy comprising 16 to 34 atom% of Al, 20 to 40 atom% of Fe, and the balance to make up 100 atom% of substantially pure Ni, for example, or a ternary Ni-Al-Co alloy comprising 16 to 29 atom% of Al, 30 to 60 atom% of Co, and the balance to make up 100 atom% of substantially pure Ni, for example, acquires considerably greater strength than the monophase alloy of a $Ll_2$ type intermetallic compound and, therefore, proves advantageous from the standpoint of strength.

The alloy of the present invention can be further improved in thermal resistance and strength without any sacrifice of ductility by incorporating therein a total of not more than 2.5 atom% of one or more elements selected from the group consisting of Nb, Ta, Mo, V, Ti, Mn, Cr, Zr, W, Si, Y, and Cu. If the alloy contains such impurities as B, P, As, and S in small amounts such as generally found in ordinary industrial materials, the presence of these impurities is tolerated because it poses no obstacle to the accomplishment of this invention.

To produce the alloy of this invention, the components must be prepared in the aforementioned percentage composition and should be melted by heating either in a natural atmosphere or under a vacuum. The resultant molten mixture should be quenched from its liquid state to a solidified state. For this purpose, the liquid quenching method which provides required quenching at a speed of about $10^{4°}$ to $10^{6°}$ C./sec can be advantageously utilized. Especially when the alloy is desired to be produced in the shape of a flat ribbon, it is advantageous to adopt the one-roll method, the multi-roll method, or the centrifugal quenching method which makes use of rolls made of metallic material. When it is desirable for the alloy to be in the shape of a thin wire having a circular cross section, it is commendable to adopt a method which comprises directly spewing a molten mixture of the components of alloy into a rotating body of liquid coolant thereby quenching the continuously spewed thread of molten mixture to a solid state. Particularly for the production of a thin alloy wire of good quality having a circular cross section, it is commercially advantageous to adopt the so-called spinning-in-rotary coolant method (published unexamined Japanese Patent Application No. 69948/80). This method comprises spewing a molten mixture of the components of alloy through a spinning nozzle into a rotating body of liquid coolant formed inside a rotary cylinder thereby quenching the spewed thread of molten mixture to a solid state.

The alloy of the present invention exhibits outstanding workability at room temperature as described above and, therefore, can be cold rolled or drawn. Particularly the alloy produced in the shape of a thin wire can be cold drawn continuously through an ordinary die at a reduction of area (draft) of at least 80%, with the result that the drawn alloy wire acquires notably enhanced tensile strength.

Besides the virtues of great strength and high ductility, the alloy of the present invention enjoys high resistance to corrosion, oxidation, and fatigue, ample strength at elevated temperatures, and outstanding electromagnetic properties. Thus, it is useful for various industrial materials such as reinforcing composite materials in plastics and concrete structures and fine-mesh filters.

Now, the present invention will be described more specifically below with reference to working examples. However, the invention is not limited to these examples.

EXAMPLES 1-7 AND COMPARATIVE EXAMPLES 1-3

A Ni-Al-Fe or Ni-al-co type alloy of a varying composition indicated in Table 1 was melted in an atmosphere of argon gas. Under an argon gas pressure of 2.0 kg/cm$^2$, the molten alloy was spewed through a ruby nozzle having an orifice diameter of 0.3 mm$\phi$ onto the surface of a steel roll measuring 20 cm in diameter and rotating at 3,500 r.p.m., to produce a ribbon about 50 $\mu$m in thickness and 2 mm in width. Test pieces taken from this ribbon were tested with an Instron type tensile tester for 180° intimate-contact bending property at a strain speed of $4.17\times10^{-4}$/sec. by way of rating the strength at rupture and the elongation. Other test pieces from the same ribbon were subjected to the X-ray diffraction and the observation under a penetrating electron microscope for determination of crystalline structure. The results are shown collectively in Table 1.

TABLE 1

| Run No. | Example No. | Alloy Composition (atom %) | Strength at Rupture (kg/mm$^2$) | 180° Intimate Contact Bending Property | Crystalline Structure |
|---|---|---|---|---|---|
| 1 | Comparative Example 1 | $Ni_{85}Al_5Fe_{10}$ | 40 | Bendable | Ni solid solutions |
| 2 | Example 1 | $Ni_{78}Al_{12}Fe_{10}$ | 68 | " | $Ll_2$ type nonequilibrium intermetallic compound containing anti-phase boundary |
| 3 | Example 2 | $Ni_{70}Al_{20}Fe_{10}$ | 80 | " | |
| 4 | Example 3 | $Ni_{65}Al_{25}Fe_{10}$ | 85 | " | |
| 5 | Comparative Example 2 | $Ni_{80}Al_{20}$ | 45 | Not bendable | Ni and $Ni_3Al$ in coexistence |
| 6 | Example 4 | $Ni_{75}Al_{20}Co_5$ | 84 | Bendable | $Ll_2$ type nonequilibrium intermetallic compound containing anti-phase boundary |
| 7 | Example 5 | $Ni_{70}Al_{20}Co_{10}$ | 87 | " | |
| 8 | Example 6 | $Ni_{60}Al_{20}Co_{20}$ | 95 | " | |
| 9 | Example 7 | $Ni_{55}Al_{20}Co_{25}$ | 96 | " | |

Note:
"Bendable" means that the rupture or breakage does not occur when subjected to the test for 180° C. intimate-contact bending property and the excellent tenacity can be obtained.
"Not Bendable" means that the rupture or breakage occur in the 180° C. intimate-contact bending property test, and the sample embrittled.

It is noted from Table 1 that Run Nos. 2 to 4 and Nos. 6 to 9 produced alloys conforming to the present invention and having crystalline structures formed of fine crystals measuring about 0.5 to 5 $\mu$m in diameter. The crystal grains were observed to contain therein superfine particles of anti-phase domain about 20 to 55 nm in diameter, indicating that these alloys were in a nonequilibrium state of poor regularity permitting the presence of high-density anti-phase boundaries. Thus, the alloys possessed great strength and exhibited high ductility. Run No. 1 involved incorporation of Al in an insufficient amount and, therefore, produced a solid solution of Ni which possessed poor strength at rupture. Run No. 5 used a binary alloy composition of Ni and Al and, therefore, gave an alloy structure having Ni and $Ni_3Al$ in coexistence and lacking the $Ll_2$ type nonequilibrium intermetallic compound. The alloy possessed poor strength and exhibited substantially no ductility.

EXAMPLE 8 (RUN NO. 10)

An alloy mixture consisting of 74 atom% of Ni, 18 atom% of Al, and 8 atom% of Mn was melted in an atmosphere of argon gas. Under an argon gas pressure of 4.5 kg/cm$^2$, the molten mixture was spewed through a spinning ruby nozzle having an orifice diameter of 0.13 mm$\phi$ into a rotating body of aqueous coolant kept at 4° C. and formed to a depth of 2.5 cm inside a rotary drum 500 mm$\phi$ in inside diameter, to be quenched into a solid state. Consequently, there was obtained a uniform, continuous thin wire of a circular cross section having an average diameter of 0.110 mm$\phi$.

In this case, the distance from the spinning nozzle to the surface of the rotating body of aqueous coolant was kept at 1 mm and the angle of contact between the spewed flow of molten mixture emanating from the spinning nozzle and the surface of the rotating body of aqueous coolant was kept at 70°.

The speed at which the molten alloy mixture was spewed through the spinning nozzle, as determined on the basis of the weight of the portion of molten mixture spewed through the spinning nozzle into the air for a fixed length of time, was 610 m/min.

The thin wire of alloy thus obtained was found to have 95 kg/mm$^2$ of strength at rupture and 12% of elongation and was capable of 180° intimate-contact bending.

This thin alloy wire could be amply drawn through a commercially available diamond die, without any intermediate annealing, to a diameter of 0.05 mm$\phi$. This drawing could significantly improve the strength of the thin alloy wire, with the strength at rupture heightened to 240 kg/mm$^2$ and the elongation increased by 2.5%. By X-ray diffraction and observation under an optical microscope and a penetrating electron microscope, this thin wire was found to have the structure of a $Ll_2$ type non-equilibrium intermetallic compound formed of crystal grains 2 to 3 $\mu$m in diameter which richly contained therein anti-phase boundaries.

EXAMPLE 9 (RUN NO. 11)

An alloy mixture consisting of 60 atom% of Ni, 17 atom% of Al, 18 atom% of Co, and 5 atom% of Si was processed by the same apparatus under the same conditions as in Example 8. Consequently, there was obtained a thin wire of a uniform circular cross section 0.110 mmϕ in diameter.

According to same procedure as in Example 8, this thin alloy wire was found to have 90 kg/mm$^2$ of strength at rupture and 10% of elongation and was capable of 180° intimate-contact bending.

This thin alloy could be drawn at a reduction of area (draft) of at least 90%. The drawn wire exhibited an enhanced rupture strength of 260 kg/mm$^2$. By following the procedure of Example 8, this thin wire was found to have the crystalline structure of a compound formed of fine crystal grains containing therein superfine antiphase boundaries. Thus, it was found to possess a high electric specific resistance of 115 μΩ-cm and a low electrical resistance temperature coefficient of $5\times10^{-5}$/°C.

EXAMPLES 10–15 AND COMPARATIVE EXAMPLES 4–8

A Ni-Al-Fe or Ni-Al-Co type alloy of a varying composition indicated in Table 2 was melted in an atmosphere of argon gas. Under an argon gas pressure of 2.0 kg/cm$^2$, the molten mixture was spewed through a ruby nozzle having an orifice diameter of 0.3 mmϕ onto the surface of a steel roll having a diameter of 200 mmϕ and rotating at a speed of 3,500 rpm, to afford a continuous ribbon about 50 μm in thickness and 2 mm in width. Test pieces taken from this ribbon were tested with an Instron type tensile tester for 180° intimate-contact bending property under the conditions of room temperature and $4.17\times10^{-4}$/sec. of strain speed by way of rating the strength at rupture and the elongation. Other test pieces from the same ribbon were subjected to X-ray diffraction and observation under a penetrating electron microscope for determination of crystalline structure. The results are shown collectively in Table 2.

TABLE 2

| Run No. | Example No. | Alloy Composition (atom %) | Strength at Rupture (kg/mm$^2$) | 180° Intimate Contact Bending Property | Crystalline Structure |
|---|---|---|---|---|---|
| 12 | Comparative Example 4 | $Ni_{40}Al_{35}Fe_{25}$ | — | Not bendable | B-2 Type Intermetallic Compound (with FeAl Precipitation) |
| 13 | Example 10 | $Ni_{50}Al_{30}Fe_{20}$ | 104 | Bendable | B-2 Type Intermetallic Compound (monophase) |
| 14 | Example 11 | $Ni_{50}Al_{20}Fe_{30}$ | 121 | " | Mixture of B-2 Type Intermetallic Compound and $Ll_2$ Type Intermetallic Compound |
| 15 | Example 12 | $Ni_{40}Al_{20}Fe_{40}$ | 112 | " | |
| 16 | Comparative Example 5 | $Ni_{10}Al_{15}Fe_{75}$ | — | Not bendable | B-2 Type Intermetallic Compound (with FeAl precipitation) |
| 17 | Example 13 | $Ni_{70}Al_{15}Fe_{15}$ | 71 | Bendable | $Ll_2$ Type $Ni_3Al$ Intermetallic Compound (monophase) |
| 18 | Comparative Example 6 | $Ni_{25}Al_{35}Co_{40}$ | — | Not bendable | B-2 Type Intermetallic Compound (with $Ll_2$ type $Ni_3Al$ precipitation in grain boundaries) |
| 19 | Example 14 | $Ni_{35}Al_{25}Co_{40}$ | 110 | Bendable | Mixture of B-2 Type Intermetallic Compound and $Ll_2$ type Intermetallic Compound |
| 20 | Example 15 | $Ni_{25}Al_{20}Co_{55}$ | 118 | " | |
| 21 | Comparative Example 7 | $Ni_{55}Al_{5}Co_{40}$ | 35 | " | Solid solution of Ni |
| 22 | Comparative Example 8 | $Ni_{10}Al_{15}Co_{75}$ | — | Not bendable | B-2 Type Intermetallic Compound (with $Ll_2$ type $Ni_3Al$ precipitation in grain boundaries) |

Note:
"Bendable" means that the rupture or breakage does not occur when subjected to the test for 180° C. intimate-contact bending property and the excellent tenacity can be obtained.
"Not Bendable" means that the rupture or breakage occur in the 180° C. intimate-contact bending property test, and the sample embrittled.

It is noted from Table 2 that Run Nos. 13 to 15, 19, and 20 produced alloys conforming to the present invention and formed fine crystal grains of 0.1 to 3 μm in particle diameter. Structurally, they were a monophase of B-2 type intermetallic compound and mixed phases of B-2 type intermetallic compound with $Ll_2$ type $Ni_3Al$ intermetallic compound. Particularly the alloy produced in Run No. 14 had compound grains not more than 0.2 μm in particle diameter and possessed great strength and high ductility. Run No. 21 involved incorporation of Al in an insufficient amount and produced a solid solution which possessed low strength at rupture. Run Nos. 12, 16, 18 and 22 involved incorporation of Al, Fe, and Co in excessive amounts and, therefore, assumed such crystalline structures as suffering precipitation of $Ll_2$ type $Ni_3Al$ intermetallic compound in grain boundaries, forming a monophase of B-2 type intermetallic compound, or entailing precipitation of FeAl of high regularity. They exhibited virtually no ductility and were deficient in feasibility. Run No. 17 involved incorporation of Fe in an insufficient amount and, therefore, formed a monophase of $Ll_2$ type $Ni_3Al$ intermetallic compound which tended to exhibit lower strength than the alloy obtained in Run No. 13.

EXAMPLE 16 (RUN NO. 23)

A $Ni_{55}Al_{20}Fe_{35}$ alloy mixture was melted in an atmosphere of argon gas. Under an argon gas pressure of 3.8 kg/cm$^2$, the molten mixture was spewed through a spinning ruby nozzle having an orifice diameter of 0.12 mmϕ into a rotating body of aqueous coolant kept at 4° C. and formed to a depth of 2 cm inside a cylindrical drum 500 mmϕ in inside diameter and rotating at a speed of 300 rpm to be quenched to a solid state. Consequently, there was obtained a continuous thin alloy wire having a uniform diameter of 120 μm.

In this case, the distance from the spinning nozzle to the surface of the rotating body of aqueous coolant was kept at 1 mm and the angle formed between the flow of molten alloy spewed out of the spinning nozzle and the surface of the rotating body of aqueous coolant was kept at 70°.

The thin alloy wire thus obtained had 128 kg/mm$^2$ of strength at rupture and 10% of elongation and was capable of 180° intimate-contact bending.

This thin alloy wire was thin continuously cold drawn through a commercially available diamond die without any intermediate annealing, to produce a drawn alloy wire 100 μm in diameter (draft 31%). This wire had 150 kg/mm$^2$ of strength at rupture and 3% of elongation. This wire was further drawn to a diameter of 38 μm (draft 90%). The drawn alloy wire consequently acquired notably enhanced strength, registering 234 kg/mm$^2$ of strength at rupture and 2.5% of elongation. By X-ray diffraction and observation under an optical microscope and a penetrating electron microscope, this drawn alloy wire was found to possess the structure of a mixed phase of B-2 type intermetallic compound with $Ll_2$ type $Ni_3Al$ intermetallic compound, formed of crystal grains 1 to 2 μm in particle diameter.

EXAMPLES 17 TO 27

For the purpose of studying the effect of an additive elements, M (one member selected from the group consisting of Nb, Ta, V, Ti, Cu, and Y), upon a $Ni_{(70-x)}Al_{20}Fe_{10}M_x$ alloy or $Ni_{(50-x)}Al_{20}Fe_{30}M_x$, a ribbon about 50 μm in thickness was prepared of a varying alloy composition indicated in Table 3 by using the apparatus and the conditions used in Example 1. The ribbon was tested for strength at rupture and for 180° intimate-contact bending property. The results are collectively shown in Table 3.

TABLE 3

| Run No. | Example No. | Alloy Composition (atom %) | Strength at Rupture (kg/mm$^2$) | 180° Intimate Contact Bending Property |
|---|---|---|---|---|
| 24 | Example 17 | $Ni_{68}Al_{20}Fe_{10}Nb_2$ | 90 | Bendable |
| 25 | Example 18 | $Ni_{68}Al_{20}Fe_{10}Ta_2$ | 95 | " |
| 26 | Example 19 | $Ni_{68}Al_{20}Fe_{10}Mo_2$ | 87 | " |
| 27 | Example 20 | $Ni_{68}Al_{20}Fe_{10}V_2$ | 90 | " |
| 28 | Example 21 | $Ni_{68}Al_{20}Fe_{10}Ti_2$ | 93 | " |
| 29 | Example 22 | $Ni_{68}Al_{20}Fe_{10}Cu_2$ | 85 | " |
| 30 | Example 23 | $Ni_{48}Al_{20}Fe_{30}Nb_2$ | 140 | " |
| 31 | Example 24 | $Ni_{48}Al_{20}Fe_{30}Ta_2$ | 135 | " |
| 32 | Example 25 | $Ni_{48}Al_{20}Fe_{30}V_2$ | 126 | " |
| 33 | Example 26 | $Ni_{48}Al_{20}Fe_{30}Ti_2$ | 125 | " |
| 34 | Example 27 | $Ni_{48}Al_{20}Fe_{30}Y_2$ | 125 | " |

Note:
"Bendable" means that the rupture or breakage does not occur when subjected to the test for 180° C. intimate-contact bending property and the excellent tenacity can be obtained.

It is noted from Table 3 that incorporation of Nb, Ta, Mo, V, Ti, Cu, or Y in an amount of 2 atom% could improve the strength at rupture by a varying extent of 5 to 20 kg/mm$^2$ without appreciably lowering the ductility.

While the invention has been described in detail and with reference to specific embodiments thereof, it will be apparent to one skilled in the art that various changes and modifications can be made therein without departing from the spirit and scope thereof.

What is claimed is:

1. A Ni-based alloy consisting essentially of a $Ll_2$ type nonequilibrium intermetallic compound comprised of 8 to 28 atom% of Al, 2 to 25 atom% total of at least one element selected from the group consisting of Fe, Co, Mn, and Si, wherein if Fe is present it is present in an amount within the range of 2 to 15 atom%, and the balance of the alloy to make up 100 atom% of substantially pure Ni, wherein the alloy is comprised of microcrystal particles having a diameter of about 0.5 to 10 microns and the $Ll_2$ type nonequilibrium compound is comprised of particles of antiphase domain having a diameter of 5 to 70 nm.

2. A Ni-based alloy as claimed in claim 1, wherein Fe is present in an amount within the range of 2 to 10 atom%.

3. A Ni-based alloy consisting essentially of:

8 to 34 atom% Al;

15 to 70 atom% total of at least one element selected from the group consisting of Fe and Co, wherein if Fe is present it is present in an amount of at least 15 atom%;

and if Co is present it is present in an amount of at least 25 atom%; and the balance of the alloy to make up 100 atom% substantially pure Ni wherein the alloy contains a B-2 type intermetallic compound, and the compound has crystals which have a minute particle diameter of not more than about 10 microns.

4. A Ni-based alloy as claimed in claim 1, wherein Fe is present in an amount within the range of 2 to 15 atom%.

5. A Ni-based alloy as claimed in claim 1, further comprising at least one element selected from the group consisting of Nb, Ta, Mo, V, Ti, Cr, Zr, W, Y, and Cu in an amount of 2.5 atom% or less.

6. A Ni-based alloy as claimed in claim 1, wherein the alloy is formed by quenching a molten mixture thereof to the solidified state in liquid at a speed of about $10^{4°}$ to $10^{6°}$ C./sec.

7. A Ni-based alloy as claimed in claim 3, further comprising at least one element selected from the group consisting of Nb, Ta, Mo, V, Ti, Mn, Cr, Zr, W, Si, Y, and Cu in an amount of 2.5 atom% or less.

8. A Ni-based alloy as claimed in claim 1, wherein the alloy is comprised of 10 to 25 atom% of Al, and 5 to 20 atom% total of at least one element selected from the group consisting of Fe, Co, Mn and Si, wherein if Fe is present it is present in an amount of 5 to 15 atom%.

9. A Ni-based alloy as claimed in claim 3, wherein Al is present in an amount of 15 to 34 atom%; Fe, if present, is present in an amount of 20 to 70 atom%; and Co, if present, is present in an amount of 30 to 70 atom%, and wherein the alloy has a monophase structure of a B-2 type intermettable compound.

10. A Ni-based alloy as claimed in claim 3, wherein Al is present in an amount of 8 to 25 atomic %; Fe, if present, is present in an amount of 20 to 70 atom%; and Co, if present, is present in an amount of 30 to 70 atom%, wherein crystal grains of a B-2 type intermetallic compound and crystal grains of a $Ll_2$ type nonequilibrium intermetallic compound are intermingled.

11. A Ni-based alloy as claimed in claim 3, comprising a ternary Ni-A-Fe alloy of 16 to 24 atom% Al, 20 to 40 Atom% Fe, and the balance to make up 100 atom% of substantially pure Ni.

12. A Ni-based alloy as claimed in claim 3, comprising a ternary Ni-Al-Co alloy of 16 to 29 atom% Al, 30 to 60 atom% Co and the balance to make up 100 atom% of substantially pure Ni.

* * * * *